United States Patent [19]

Lautzenheiser

[11] 4,432,044

[45] Feb. 14, 1984

[54] TASK LIGHTING SYSTEM

[75] Inventor: Terry L. Lautzenheiser, Grand Rapids, Mich.

[73] Assignee: Steelcase Inc., Grand Rapids, Mich.

[21] Appl. No.: 247,848

[22] Filed: Mar. 26, 1981

[51] Int. Cl.[3] ..... F21S 3/00

[52] U.S. Cl. ..... 362/223; 362/19; 362/33; 362/256; 362/260; 362/269; 362/307; 362/311; 362/323

[58] Field of Search ..... 362/217, 223, 248, 255, 362/256, 260, 277, 293, 307, 311, 319, 322, 323, 269, 19, 33

[56] References Cited

U.S. PATENT DOCUMENTS

| | | | |
|---|---|---|---|
| 2,374,161 | 4/1945 | Belden | 362/255 |
| 4,186,431 | 1/1980 | Engel | 362/255 |
| 4,254,449 | 3/1981 | Benasutti | 362/33 |

FOREIGN PATENT DOCUMENTS

| | | |
|---|---|---|
| 7305118 | 6/1974 | France . |

*Primary Examiner*—Donald P. Walsh

*Attorney, Agent, or Firm*—Price, Heneveld, Huizenga & Cooper

[57] ABSTRACT

A task lighting system is disclosed including a reflector which supports a light source such as a fluorescent light tube. An at least translucent, member covers the light source and extends along its entire length. A variable light transmission pattern is carried by the elongated tube. The light transmission pattern has a density which is directly proportional to the brightness levels of the light source, both longitudinally and circumferentially thereof. The variable light transmission pattern is defined by a plurality of opaque markings and is positionable within the reflector so that the light source has an apparent uniform brightness. The variable light transmission pattern controls veiling reflections which can occur when an observer views a task having a given specularity. The member is movable with respect to the light source to vary the brightness of the luminaire.

18 Claims, 9 Drawing Figures

TASK LIGHTING SYSTEM

BACKGROUND OF THE INVENTION

The present invention relates to lighting systems and more particularly to a luminaire for illuminating a task supported on a horizontal work surface.

Heretofore, a wide variety of lighting systems have been proposed for general office and home use. Certain of these systems have been designed to illuminate tasks which are positioned on a horizontal work surface such as a desk. Such task lighting systems may be mounted over the work area and/or suspended from shelves, bookcases and the like. Depending upon the particular type of task being viewed, the light source may be reflected off the task and seen by the observer. Reflection of the light source is directly related to the specularity of the task. For example, when the observer is reading or viewing a shiny magazine page, the light source may be seen and glare or "veiling reflections" occur. Task lighting systems or luminaires, while being designed to provide a predetermined or required illumination at the area of the task, should also be designed to control the specular brightness of the task to avoid such veiling reflections.

Veiling reflections may be a problem only with certain types of tasks. For example, if a light, diffuse paper, such as bond paper, is the task and the user is employing a black felt tip pen, veiling reflections are not a problem.

Various proposals have been made to eliminate or control veiling reflections. Typical prior approaches have reduced the brightness of the light source at the central area thereof. These approaches in effect "place" the light source out of a defined zone within which the task is expected to be positioned. An example of one such system employs a lens which has a so-called "bat-wing" light distribution pattern. The lens system in effect redirects light to the sides of the work surface and reduces the energy or brightness levels in defined directions in which any task specularly will reflect it to the viewer.

Another approach which has heretofore been employed is to place a baffle such as an opaque plate at the central area of the light source. The baffle prevents transmission of light from an area of the light source to the task. The task is illuminated by side lighting. Veiling reflections are eliminated as long as the task is positioned in a defined zone. Should the user move the task to the sides of the work surface, veiling reflections will again become a problem with either the "bat-wing" lens or the baffle approach.

The aforementioned prior approaches to eliminating veiling reflections have merely "blocked" the central area of the source and permitted side light to illuminate the task sufficiently for viewing and/or reading purposes.

An example of one prior system may be found in U.S. Pat. No. 4,054,793, entitled LIGHTING SYSTEM and issued on Oct. 18, 1977, to Shemitz. This patent discloses a lighting fixture including an elongated housing, a light source and a refractor element which distributes luminous flux from the light source in a bat-wing configuration. Another example of a refractor plate which distributes luminous flux from the light source in a bat-wing configuration may be found in U.S. Pat. No. 3,258,590, entitled PLATES FOR LIGHT CONTROL and issued on June 28, 1966, to Goodbar.

Other task lighting systems have attempted to control veiling reflections by polarizing the light emanating from the light source before it strikes the task. When a polarizing filter material is placed in front of the light source so that it is intercepted by light emanating towards the task, the light is polarized before it strikes the surface. This polarization, of course, eliminates one of the components of the light. Upon reflection, the remaining component is also eliminated. This polarizing concept does not block light emanating from the light source. An example of a polarizing system may be found in U.S. Pat. No. 3,239,659, entitled GLARE-REDUCING LAMP and issued on Mar. 8, 1966, to Makas.

In situations where veiling reflections are not a problem because of the task characteristics, the brightness level of the luminaire could desirably be increased. This would increase the illumination which may be wanted by the user. Prior systems have not provided for ready adjustability of illumination levels.

A need exists for a luminaire or task lighting system which will control veiling reflections across the entire work surface yet which permits adjustment of illumination levels to the particular task being viewed and which accommodates differences in geometric orientation, task position, observer eye position and the height of the luminaire above the task so that the user can maximize the effectiveness of the luminaire.

SUMMARY OF THE INVENTION

In accordance with the present invention, the aforementioned needs are substantially fulfilled. Essentially, the present invention encompasses a task light control mask. The control mask includes an at least translucent, member adapted to be supported at the light source. A variable light transmission means is carried by the member. The light transmission means controls the apparent brightness of the light source to reduce the brightness contrast across the luminaire and control veiling reflections. Provision is made for adjusting the position of the variable light transmission means with respect to the light source so that illumination levels can be controlled and the luminare may be adjusted for the particular task being viewed.

In narrower aspects of the invention, the light source and light mask member are supported within a large area, diffuse reflector. The reflector increases the apparent area of the light source thereby reducing the brightness of the system per square unit of area. As a result, the light which is reflected by the specularity of the task into the eye of the user is less bright. A reduction in the specular brightness of the task is achieved which improves the apparent quality of the viewing situation.

In an existing embodiment, the variable light transmission means is defined by a blocking medium. The medium has a pattern which is essentially configured to match the brightness of the reflector near the lamp and to create an apparently, uniform brightness level for the portion of the luminaire which might be reflected. The pattern reduces high areas of illumination at the work surface by a reduction in light transmission through the mask. Uniformity of illumination at the task area is achieved, and veiling reflections are controlled.

It is preferred that the member be rotatably adjustable within the reflector with respect to the light source. As a result, the mask pattern may be moved into and out of the area from which light emanates from the light source to the task. This permits adjustment by the user of the brightness levels achieved by the luminaire. As a result, adjustment for geometric differences, eye position differences and height of the unit above the task are readily achieved.

The task lighting system in accordance with the present invention permits the user to control veiling reflections and obtain an apparent uniform brightness without the use of lenses and/or opaque plates or baffles. This reduces significantly the overall size of the luminaire that would otherwise be necessary to achieve the same results. This is a significant advantage to the furniture designer since the lighting system is more readily accommodated to specific furniture design/size constraints. Aesthetics are more readily achieved at a reduced cost of manufacture. The luminaire may be integrated or built directly into a cabinet structure. Such integration of lighting systems with surrounding furniture has not heretofore been as readily or as easily achieved.

DETAILED DESCRIPTION OF THE PREFERRED EMBODIMENT

Figure 1:
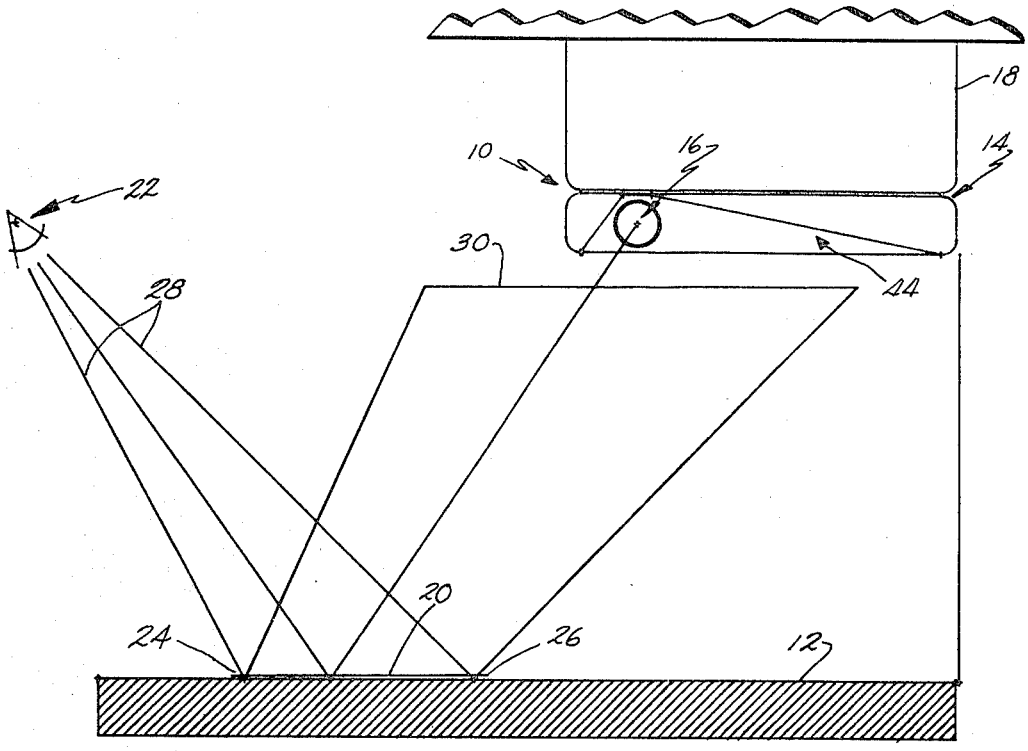
FIG. 1 is a schematic, side elevation of a lighting system in accordance with the present invention.

With reference to the drawings, FIG. 1 schematically illustrates a light control system in accordance with the present invention which is primarily adapted for illuminating a task. The system includes a luminaire generally designated 10 which is supported above a generally horizontal work surface 12. Luminaire 10 includes a reflector generally designated 14, an elongated, linear light source 16 including a control mask 17. In the embodiment shown, source 16 is a fluorescent tube. Luminaire 10 may be suspended from the undersurface of a cabinet, shelf or the like and which is generally designated 18. In the alternative, luminaire 10 could be supported from separate bracket structure in a position above the work surface 12.

Luminaire 10 is primarily adapted to illuminate a task 20 which is illustrated in a position on the work surface 12. As shown in FIG. 1, an observer may view the task from a position generally designated 22. The task has leading and trailing edges 24, 26. From the light rays 28, it should be apparent that the task defines a critical brightness zone 30 which is subject to the aforementioned veiling reflections. Light in the zone 30, that is, within the boundaries of the leading and trailing edges 24, 26 of the task, could be reflected to the eye of the observer 22. It should be understood that as the task is moved both longitudinally and from the front to back of the work surface 12, the critical brightness zone would necessarily shift.

Figure 2:
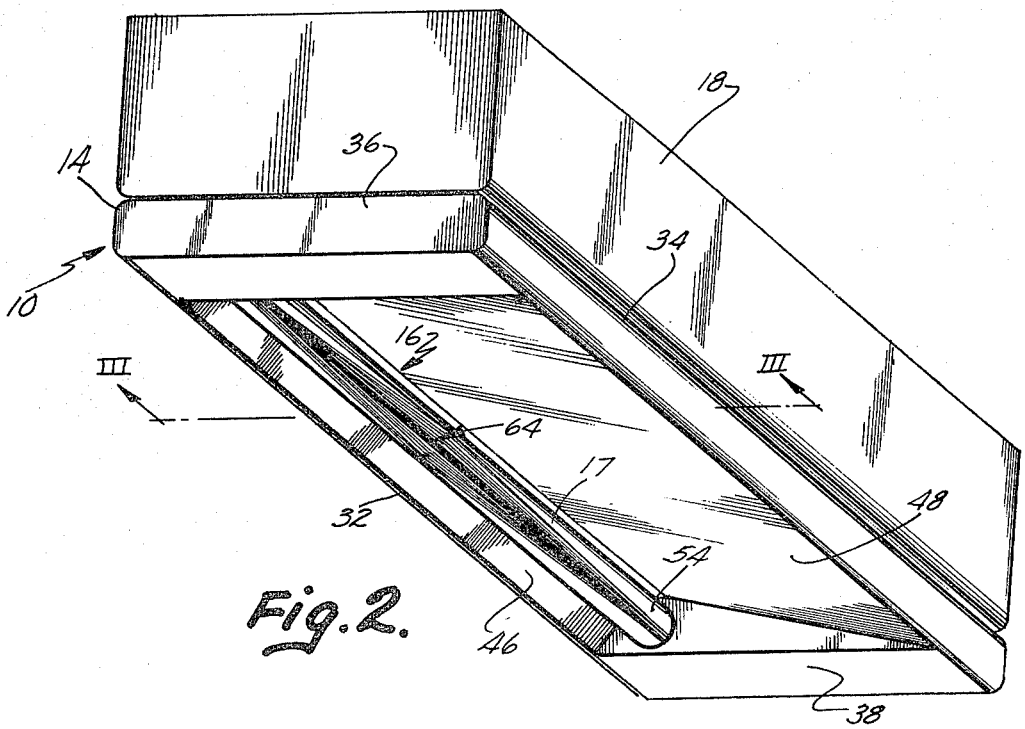
FIG. 2 is a perspective, bottom elevational view of the lighting system.
Figure 3:
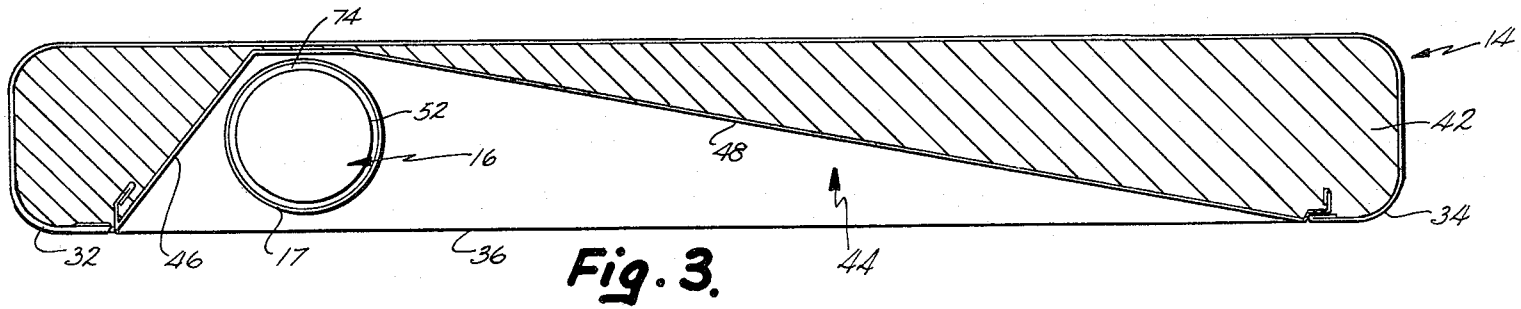
FIG. 3 is a cross-sectional view taken generally along line III—III of FIG. 2.

As seen in FIGS. 2 and 3, reflector 14 of luminaire 10 includes first and second lateral edges 32, 34 and ends 36, 38. In the embodiment illustrated, the light source 16 and light control mask 17 extend between and are supported by ends 36, 38. It is presently preferred that the light source 16 and control mask 17 be supported immediately adjacent lateral edge 32. When mounted from a support structure 18, lateral edge 32 would be facing the viewing position generally designated 22. This positioning of the light source is preferred since the elongated tube will be essentially "hidden" from the eye of the observer.

Reflector 14 includes a support or body 42 to which is secured a diffuse reflector 44 (FIG. 3). Reflector 44 includes a first, angled portion 46 immediately adjacent the elongated linear light source 16. Reflector 44 slopes generally away from the light source 16 along a portion designated 48. As should be apparent from the drawings, the reflector is a "large area" reflector which increases the apparent area source of the light emanating from the light source 16. This reduces the brightness of the luminaire or system per square unit of area.

Figure 4:
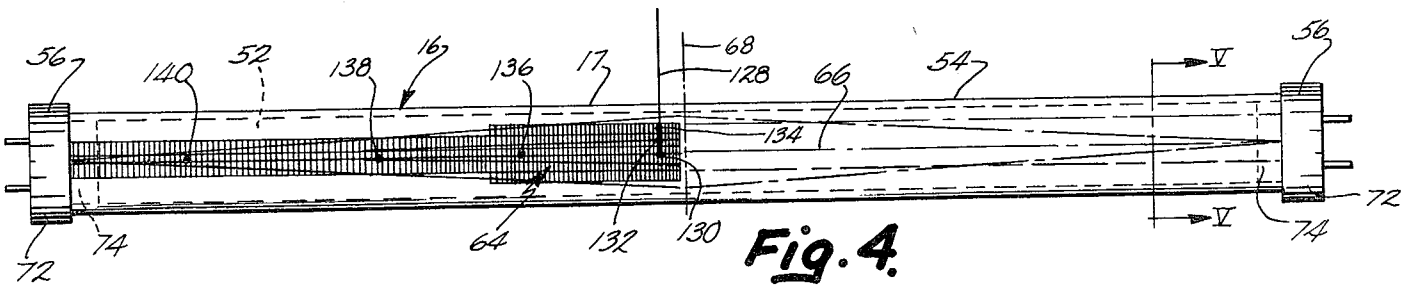
FIG. 4 is a front, elevational view of an elongated light source and light control mask in accordance with the present invention.
Figure 5:
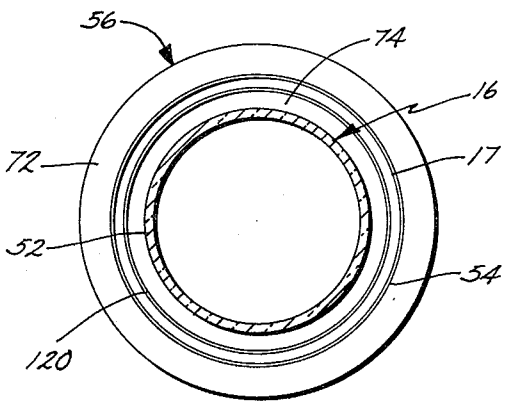
FIG. 5 is a cross-sectional view taken generally along line V—V of FIG. 4.

In the structure of FIGS. 4 and 5, light source 16 is a fluorescent light tube or elongated, linear light source 52. Supported around and substantially encircling the tube 52 is light control mask 17. Mask 17 includes a generally tubular shaped member 54. Member 54 is at least translucent and preferably transparent. Tubular member 54 extends throughout the entire length or longitudinal dimension of the fluorescent tube 52. Tube 52 is supported within tubular member 54 by end caps 56. The tubular member 54 is of a conventional configuration which has heretofore been marketed to protect the lamp from accidental breakage. An example of such a tube may be found in U.S. Pat. No. 3,676,401, entitled FLUORESCENT LAMP PROTECTION APPARATUS and issued on June 27, 1972, to DuPont. It is presently preferred that the tube be extruded from a clear polycarbonate material.

As seen in FIGS. 2 and 4, tube or member 54 carries and/or supports a variable light transmission means which is generally designated 64. The variable light transmission means extends throughout the longitudinal dimension of tube 54 and hence the fluorescent tube 52. Further, variable light transmission means 64 extends circumferentially of the tube 54. The variable light transmission means 64 is defined by a plurality of regularly spaced lines. These lines define a pattern of opaque markings which is symmetrical about a longitudinal axis 66 and about a vertical centerline 68 (FIG. 4).

A fluorescent tube does not produce a uniform brightness level throughout its length. Typically, such tubes are brighter along their longitudinal centerlines and in a central area intermediate the ends. The brightness levels of such tubes taper off from their vertical centerlines to their ends. Brightness varies along longitudinal and circumferential dimensions of the tube. This causes nonuniform illumination levels at the work surface. The entire work surface is not fully usable for positioning the task.

The primary purpose of the variable light transmission means 64 is to reduce the apparent brightness of the light source in a direction in which it would be reflected by the task. The objective is to match the brightness of the reflector near the lamp to create a uniform or apparent uniform brightness. The variable light transmission means 64 also reduces high areas of illumination, i.e., along the central area of the tube, so that uniformity of lighting at the task area is achieved.

Each end cap 56 has a circular flange portion 72 which is joined to a generally cylindrical hub portion 74. Hub portion 74 defines a central throughbore which receives the ends of the fluorescent light tube 52. The end caps are pressed into the open ends of elongated tubular member 54. As a result, tubular member 54 may be rotated relative to the fluorescent tube 52. As explained in detail below, this permits positioning of the variable light transmission means 64 to adjust for illumination levels and geometric differences encountered in mounting the luminaire with respect to a task. As explained in detail below, the adjustability feature allows the user to maximize the effective illumination of the system and to match such illumination levels to the particular task which is being viewed.

Figure 6:
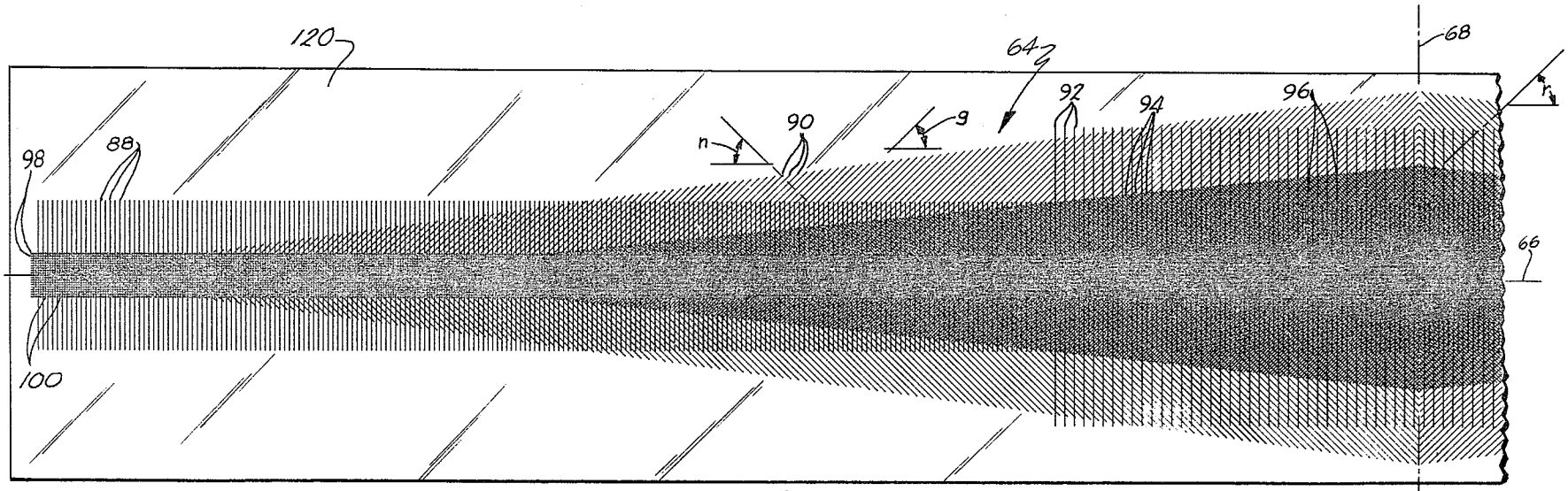
FIG. 6 is a plan view of a portion of the variable light transmission means incorporated in the present invention.

A portion of the variable light transmission means 64 is illustrated in FIG. 6. As should be readily apparent from FIGS. 4 and 6, variable light transmission means 64 is symmetrical about longitudinal axis 66 and about the vertical axis 68. As a result, only one-half of the pattern has been illustrated in detail.

Means 64 includes a plurality of regularly spaced, opaque lines or markings which define a pattern 82 having a varying density or open area. The opaque markings are in effect "overlayed" and define a plurality of zones which have been dimensioned in FIG. 7. The pattern having the dimensions of FIG. 7 was developed for use with an F-40, T-12 fluorescent light tube. Such a tube has an overall length of 4 feet, a 12/8 inch diameter and is rated at 40 watts.

The opaque lines, as should be readily apparent, define varying open areas or densities. The open areas or densities vary from the vertical centerline 68 towards the outer ends of the pattern along the longitudinal centerline 66. The pattern has more "open area" or is less dense as it approaches the ends than it has adjacent the central area about the vertical centerline 68.

A fluorescent light tube has a greater apparent brightness immediately about and along longitudinal centerline 66. Further, the brightness of the tube is greater about the vertical centerline 68 and hence within a central area of the tube. As discussed above, prior approaches to eliminating veiling reflections have modified the illumination pattern of the fluorescent tube by eliminating light from the central area and redirecting it to the side areas. Such systems are exemplified by the so-called bat-wing lenses and by the approaches which have positioned an opaque plate or a plurality of baffles immediately adjacent and about the vertical centerline of the tube. These plates, baffles and lenses have eliminated direct light from the central area of the tube to the horizontal surface 12 where task 20 would be positioned. Typically, the task would be supported on the work surface at the central area of the light source. By eliminating the high brightness from the center of the light source, veiling reflections can be reduced since the task is essentially illuminated by side light. Veiling reflections will, however, remain a problem should the user move the task towards either end of the light source and away from the area from which direct vertical light transmission is blocked.

In accordance with the present invention, this problem is eliminated. The variable light transmission means 64 extends throughout the length of the linear light source and creates an apparent uniform brightness from the luminaire. As a result, the user can move the task towards either end of the work surface and veiling reflections will not be a problem. The mask may be adjusted for the particular eye position and geometric arrangement of the luminaire with respect to the work surface.

Figure 7:
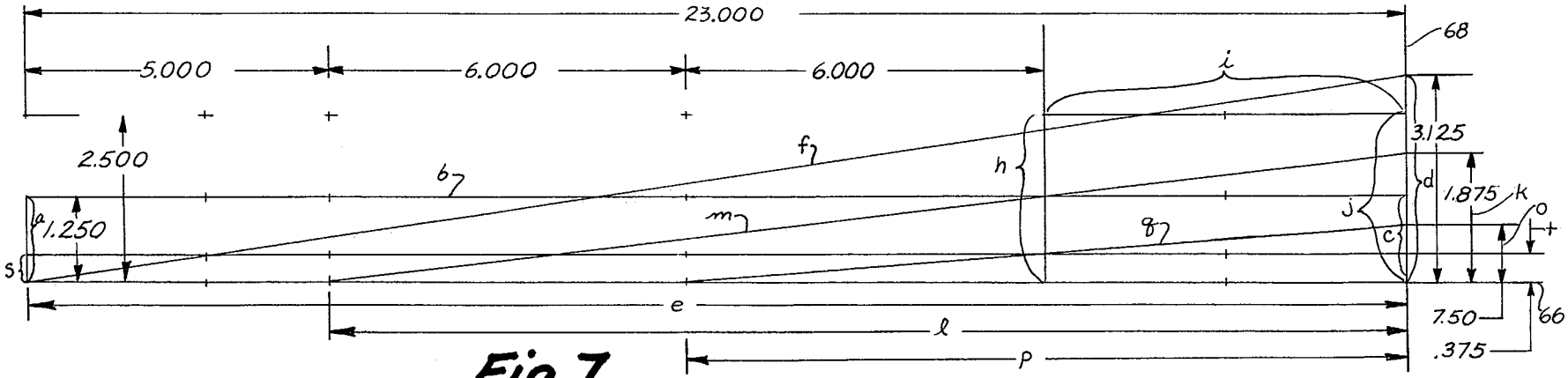
FIG. 7 is a schematic view showing the dimensions of a quadrant of one embodiment of the variable light transmission means of FIG. 6.

As mentioned above and as shown in FIGS. 6 and 7, means 64 is defined by a plurality of overlayed patterns of opaque lines. Since means 64 is symmetrical about longitudinal 66 and vertical 68, only a single quadrant of the pattern for the existing embodiment will be described in detail. The quadrant (FIGS. 6 and 7) includes a rectangular pattern bounded by lines a, b and c. Within the boundary lines a, b and c are a plurality of vertically extending lines 88. Lines 88 have a height dimension of 1.250 inches (FIG. 7). Lines 88 are equally spaced along the boundary b which has a dimension of 23 inches. Lines 88 are spaced at 0.10 inch intervals along longitudinal 66.

Another pattern of lines is overlayed on lines 88. This pattern is triangular and is bounded by a side d, a base e and a hypotenuse f. The pattern includes a plurality of equally spaced, parallel lines 90 which extend from base e at an angle g of 45° (FIG. 6). Side d has a dimension of 3.125 inches and base e has a dimension of 23 inches. Lines 90 are spaced at 0.10 inch intervals within boundaries d, e and f.

Another pattern of parallel lines 92 is formed within boundaries h, i and j (FIGS. 6 and 7). Lines 92 extend perpendicular to centerline 66 and are spaced from each other at 0.20 inch intervals. Boundaries h and j have a vertical height of 2.50 inches, and line i has a length of 6.00 inches.

Another triangular pattern bounded by a side k, a base 1 and a hypotenuse m is overlayed on the other patterns. Boundary k has a dimension of 1.875 inches, and base 1 has a dimension of 18.00 inches. Within boundaries k, l and m are a plurality of lines 94. Lines 94 are angled with respect to base 1 at an angle n of 45° and spaced at 0.05 inch intervals (FIG. 6).

A final triangular pattern is bounded by a side o, a base p and a hypotenuse q. Boundary or side o has a dimension of 0.750 inches, and base p has a dimension of 12 inches. Parallel lines 96 are spaced within boundaries o, p and q. Lines 96 are spaced at 0.05 inch intervals and are angled with respect to base p at an angle r of 45° (FIG. 6).

Means 64 includes a final rectangular pattern of perpendicularly related lines 98, 100 bounded by sides s, t and e. Boundaries s and t have a dimension of 0.375 inches, and boundary e has a dimension of 23 inches. Lines 98 extend parallel to each other and parallel to longitudinal 66. Lines 100 extend parallel to each other and perpendicular to longitudinal 66. Lines 98 are spaced from each other at 0.050 inch intervals. Lines 100 are spaced from each other at 0.50 inch intervals. The width dimension of each of the lines of all the patterns is approximately 0.050 to 0.055 inches.

The presently existing embodiment of the variable light transmission means 64 described above and illustrated in FIG. 6 is photo offset printed on a sheet designated 120 in FIG. 6 of clear plastic material. The presently preferred material is polyester. The sheet of clear plastic material having the patterns imprinted thereon is rolled and inserted into the light control mask tube 54. This is illustrated in FIG. 5. As a result, the sheet of material 120 is carried and supported within tube 54 which therefore carries or supports the opaque markings. In the alternative, the pattern could be imprinted directly on the clear or translucent tube 54. At present, however, the tubes are obtained as seamless extrusions. If imprinted directly on the tubes, the tube could initially be formed as a flat sheet with the pattern imprinted thereon. The sheet would then be rolled to the desired configuration. The pattern might also be silk screened directly on the tube.

Figure 9:
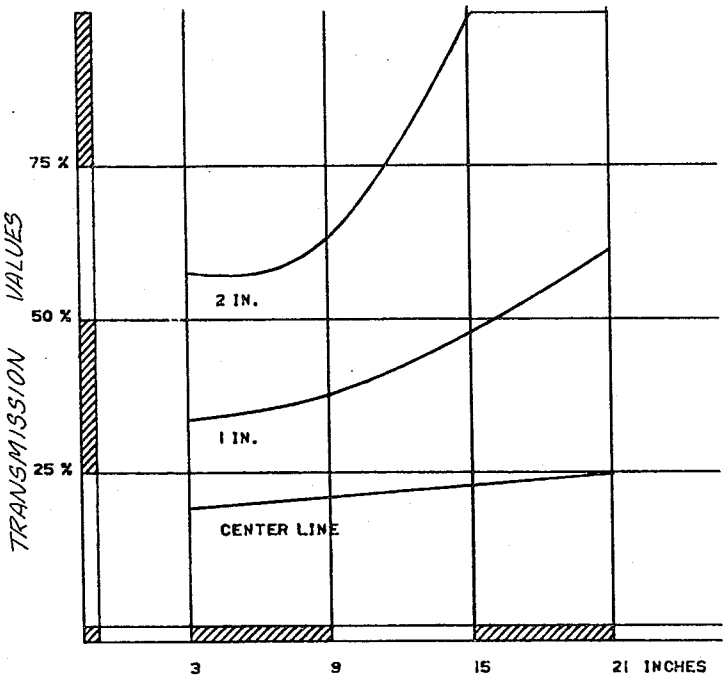
FIG. 9 is a graph illustrating the variation in the light transmission values across longitudinal sections of the control mask.
Figure 8:
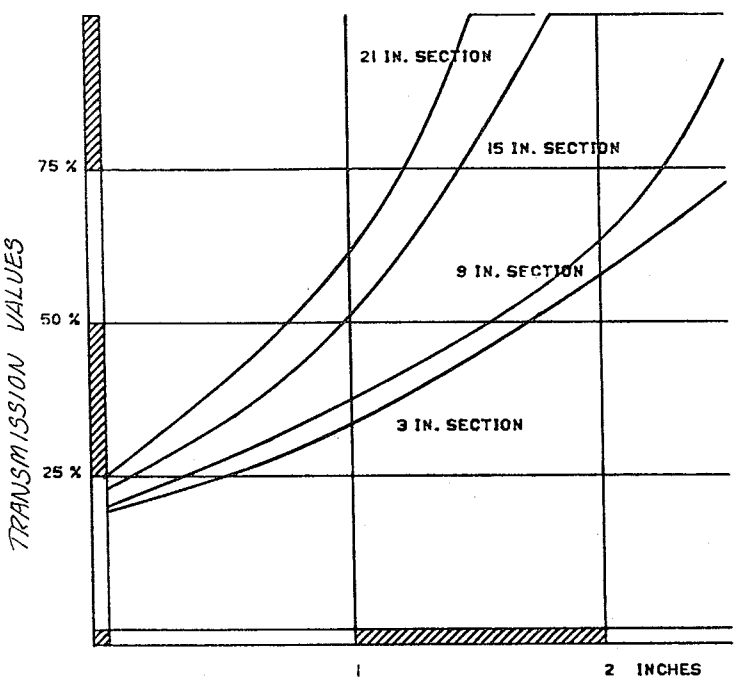
FIG. 8 is a graph showing the approximate light transmission values across radial sections of the control mask dimensioned on the circumference.

The specific pattern of lines illustrated in FIG. 6 for the presently existing embodiment produces light transmission values approximated in the graphs of FIGS. 8 and 9 when surrounding an F-40, T-12 fluorescent tube. FIG. 8 is a graph showing the light transmission values (Y ordinate) for the mask at radial sections (X ordinate) dimensioned on the circumference of the mask tube and pattern. For example, the line designated "3 inch section" shows the variance in the transmission values from the centerline 66 circumferentially or perpendicular thereto along a vertical or circumferential line three inches from vertical 68. This is illustrated in FIG. 4. As shown therein, a line 128 has three data points marked thereon and designated 130, 132 and 134. Line 128 extends perpendicular to longitudinal 66 at a point spaced 3 inches from vertical centerline 68 along the longitudinal. Hence it is a three inch section. At the centerline and hence at point 130, the light transmission value is approximately 20%. At point 132, one inch from the centerline along line 28, the light transmission value is approximately 35%. At point 134, two inches from the centerline along the circumference, the light transmission value is approximately 60%. Similar measurements were made for vertical or circumferential lines spaced from the centerline 68 along longitudinal 66 at 9, 15 and 21 inches. The values obtained were marked on the graph and the lines defining the graph were smoothed through the several data points. As a result, the light transmission values obtained from FIG. 8, except at the specific data points, are approximations of the actual values which would be achieved by the mask illustrated in FIG. 6.

FIG. 9 illustrates the light transmission values along longitudinal sections of the mask taken along a line coincident with the centerline, a line one inch from the centerline and extending parallel thereto and a line two inches from the centerline and extending parallel thereto. The line designated "centerline" in FIG. 9 represents the light transmission values for points designated 130, 136, 138 and 140 in FIG. 4. The data points are respectively at points along or parallel to the longitudinal at 3, 9, 15 and 21 inches from the vertical centerline 68. As shown, the light transmission values along the centerline towards the ends vary from approximately 20% to approximately 25%. The curves illustrated in FIG. 10 are also approximations. For example, the values given for the "2 inch section" represent a "smoothed curve" for values measured three inches from the centerline, nine inches and fifteen inches from the centerline. The measured values at three and nine inches are plotted on the graph. The value at fifteen inches is 100% since this point is out of the area of the pattern. The two inch line was then smoothly drawn inbetween these data points.

Different line patterns or other transmission control mediums having open areas and/or densities which vary longitudinally and circumferentially of the control mask and which approximate the transmission values given in FIGS. 8 and 9 would be in accordance with the present invention. Such a light control mask and/or variable transmission means would be able to eliminate veiling reflections by approximating a uniform brightness level throughout the length of the fluorescent tube.

OPERATION

The luminaire in accordance with the preferred embodiment is assembled by inserting the fluorescent tube within the control mask defined by tube 54 and variable light transmission means 64. End caps 56 rotatably support tube 54 with respect to the light source. The assembly is mounted within reflector 44. The reflector is supported above the horizontal work surface. The narrow vertical height of the luminaire permits the furniture designer to readily integrate the lighting system into the furniture or office system. For example, the luminaire may be secured directly to or in the undersurface of a cabinet suspended from a panel and above a desk or other work area.

The user can rotate tube 54 to position the variable light transmission means. This adjusts the illumination levels to the particular task being viewed. Essentially uniform illumination can be obtained when the pattern is positioned to block light along the entire length of the fluorescent tube. When so positioned, a task having high specularity may be moved around on the work surface without encountering veiling reflections. If a higher illumination level is desired, tube 54 can be rotated to move some of the pattern out of line with rays from the light to the task. The invention, therefore, provides a full range of adjustability. Size and cost restraints heretofore experienced are substantially reduced. Adustment can be made for geometric differences in the mounting of the luminaire with respect to the work surface and for eye position differences.

In view of the foregoing description, those of ordinary skill in the art will undoubtedly envision various modifications which would not depart from the inventive concepts disclosed herein. The variable light transmission concept to control brightness could be employed with light sources other than the fluorescent tube shown. Also, the concept might be employed in systems other than task lighting systems. The specific configuration of the reflector of the luminaire shown could be varied while still obtaining the desired results. A diffuse, large area reflector is preferred, however, in order to increase the apparent area source of light emanating from the luminaire. Further, the luminaire including the light control mask and variable transmission means in accordance with the invention would function if the light source were supported adjacent the opposite lateral edge of the reflector from that illustrated. It is preferred, however, that it be mounted in the position shown so that it is essentially hidden from the observer when suspended beneath a shelf, cabinet or supported by other bracket structure. Further, as set forth above, the precise pattern of opaque markings employed or the manner of defining the pattern having varying light transmission values could differ from that illustrated. Other means such as variable density shading or a variable translucency on a sheet of material could be employed to obtain similar results.

Therefore, it is expressly intended that the above description should be considered as only that of the preferred embodiment. The true spirit and scope of the present invention may be determined by reference to the appended claims.

The embodiments of the invention in which an exclusive property or privilege is claimed are defined as follows:

1. A light control mask for use with a generally linear light source to control light distribution, said mask comprising:

an elongated, generally tubular member having dimensions substantially equal to that of the light source and defining a longitudinal dimension;

means for rotatably supporting said tubular member around the light source; and variable light transmission means extending substantially along the entire longitudinal dimension of said member for controlling the amount of light transmitted through said member to thereby reduce areas of illumination longitudinally of said member and in a central area of said member so that said member can transmit less light in an area than at other areas and a more uniform brightness can be achieved, said variable light transmission means comprising a plurality of opaque markings which define a pattern having a longitudinal centerline and a vertical centerline along dimensions of said member, said pattern being relatively dense along a longitudinal centerline of the member to reduce high illumination levels which would emanate from a linear light source disposed within said member, said pattern being denser in said central area of said tubular member than adjacent the ends of the member, said pattern varying in density circumferentially of said member, and said light transmission means having a light transmission value along its longitudinal centerline which varies from approximately 20% at the vertical centerline of the member to approximately 25% at the ends of the member, said pattern being a mirror image of itself about the vertical centerline of the member.

2. A light control mask as defined by claim 1 wherein said member is an elongated, cylindrical tube, said pattern extending circumferentially of said member.

3. A light control mask as defined by claim 2 wherein said pattern is imprinted directly on said member.

4. A light control mask as defined by claim 2 wherein said pattern is imprinted on a transparent sheet of material which is carried by said member.

5. A light control mask as defined by claim 2 wherein said pattern is defined by a plurality of overlayed, spaced opaque lines.

6. A light control mask as defined by claim 5 wherein the pattern has a light transmission value along a longitudinal section which is one inch from the longitudinal centerline which varies from approximately 30% at the vertical centerline of the member to approximately 60% at the end of said member.

7. A light assembly for use in illuminating a task supported on a horizontal surface below and in front of the light assembly, said assembly including:

an elongated, linear light source having a central area, a longitudinal centerline and ends;

an elongated, light transmitting member at least partially encircling said light source, said member defining at least a portion of a cylinder;

support means for rotatably supporting said member around said light source so that said member may be rotated about the longitudinal centerline of said light source; and variable light transmission means carried by said member for varying the light transmitted through said member by said light source about a longitudinal centerline of said member so that a generally uniform brightness level may be achieved along the entire length of said member, said variable light transmission means defining a pattern of opaque markings having an open area inversely proportional to the brightness levels of the light source at longitudinal points thereof, said open area of said pattern varying both circumferentially and longitudinally of said tube, said support means permitting the positioning of the light transmission means to be varied to adjust apparent brightness levels at the task and to adjust for geometric differences, eye position and height of the light assembly above the task.

8. A light assembly as defined by claim 7 wherein said pattern is symmetrical about a longitudinal centerline and about a vertical centerline thereof and said transmitting member is a cylindrical tube encircling said light source.

9. A light assembly as defined by claim 8 wherein said pattern is defined by an overlay of a plurality of regularly spaced lines.

10. A light assembly as defined by claim 8 wherein said pattern is imprinted directly on said member.

11. A light assembly as defined by claim 8 wherein said pattern is imprinted on a transparent sheet of material which is carried by said member.

12. A light assembly as defined by claim 10 wherein said pattern is defined by an overlay of a plurality of regularly spaced lines.

13. A light assembly as defined by claim 11 wherein said pattern is defined by an overlay of a plurality of regularly spaced lines.

14. A luminaire for illuminating a task and which controls veiling reflections caused by reflection of a light source off of the task, said luminaire comprising:

an elongated, diffuse reflector having first and second lateral edges joined by a transverse surface;

an elongated linear light source supported within said reflector adjacent one of said edges, said light source having a brightness level which is greater at its center than at its ends, and said reflector increasing the apparent area from which light emanates to reduce the apparent brightness per unit area of the light emanating from said luminaire;

variable light transmission means at least partially surrounding said linear light source for modifying the brightness of said light source to achieve a generally uniform level of brightness along said reflector to control veiling reflections, said light transmission means providing varying light transmissiveness circumferentially of said linear light source; and adjustment means supported by said reflector for rotatably supporting said light transmission means about said linear light source whereby said light transmission means can be rotated to adjust the apparent brightness levels at the task and to adjust for geometric differences, eye position and height of the luminaire above the task.

15. A luminaire as defined by claim 14 wherein said light transmission means comprises an elongated, at least translucent, cylindrical tube encircling said light source.

16. A luminaire as defined by claim 15 wherein said variable light transmission means further comprises an opaque pattern carried by said elongated tube.

17. A luminaire as defined by claim 16 wherein said opaque pattern extends longitudinally of said tube, said pattern having a density proportional to the variation in the brightness level of said light source along the length of the light source.

18. A luminaire as defined by claim 17 wherein the density of said pattern varies longitudinally and circumferentially of said tube.

* * * * *